US006009704A

United States Patent [19]

Feucht

[11] Patent Number: 6,009,704

[45] Date of Patent: Jan. 4, 2000

[54] EXHAUST GAS RECIRCULATION SYSTEM

[75] Inventor: Dennis D. Feucht, Morton, Ill.

[73] Assignee: Caterpillar Inc., Peoria, Ill.

[21] Appl. No.: 09/109,816

[22] Filed: Jul. 2, 1998

[51] Int. Cl.[7] ..... F02M 25/06

[52] U.S. Cl. ..... 60/278; 60/274; 60/311; 60/280

[58] Field of Search ..... 60/278, 274, 280, 60/311, 605.2

[56] References Cited

U.S. PATENT DOCUMENTS

| | | | |
|---|---|---|---|
| 5,426,936 | 6/1995 | Levendis et al. | 60/278 |
| 5,440,880 | 8/1995 | Ceynow et al. . | |
| 5,617,726 | 4/1997 | Sheridan et al. . | |
| 5,657,630 | 8/1997 | Kjemtrup et al. . | |
| 5,671,600 | 9/1997 | Pischinger et al. . | |
| 5,771,868 | 6/1998 | Khair | 123/570 |
| 5,802,846 | 9/1998 | Bailey | 60/278 |
| 5,806,308 | 9/1998 | Khair et al. | 60/278 |

*Primary Examiner*—Thomas Denion
*Assistant Examiner*—Binh Tran
*Attorney, Agent, or Firm*—Larry G. Cain

[57] ABSTRACT

Past exhaust emission control systems have failed to clean the exhaust gas prior to mixing with the intake air. The present exhaust emission control system removes at least a portion of the exhaust constituents from a flow of exhaust gas prior to mixing with a flow of intake air. The present exhaust emission control system includes a control system for monitoring a operating parameter of an engine. The control system interprets the operating parameter within a controller and the controller causes an exhaust valve regulator to move between an open position and a closed position. Thus, the movement of the exhaust valve regulator infinitely between the open position and the closed position defines the quantity of flow of exhaust gas to be mixed with the flow of intake air and controls the emission, especially of NOx, being emitted from the engine depending on the operating parameters of the engine.

19 Claims, 2 Drawing Sheets

EXHAUST GAS RECIRCULATION SYSTEM

TECHNICAL FIELD

This invention relates generally to an engines and more particularly to a reduction of exhaust emissions.

BACKGROUND ART

The use of fossil fuel as the combustible fuel in engines results in the combustion products of carbon monoxide, carbon dioxide, water vapor, smoke and particulate, unburned hydrocarbons, nitrogen oxides and sulfur oxides. Of these above products carbon dioxide and water vapor are considered normal and unobjectionable. In most applications, governmental imposed regulations are restricting the amount of pollutants being emitted in the exhaust gases.

In the past, the majority of the products of combustion have been controlled through design modifications and fuel selection. For example, at the present time smoke has normally been controlled by design modifications in the combustion chamber, particulates are normally controlled by traps and filters, and sulfur oxides are normally controlled by the selection of fuels being low in total sulfur. This leaves carbon monoxide, unburned hydrocarbons and nitrogen oxides as the emissions of primary concern in the exhaust gas being emitted from the engine.

Many systems have been developed for recycling a portion of the exhaust gas through the engine thereby reducing the emission of these components into the atmosphere. The recirculation of a portion of exhaust gas is used to reduce pollution emitted to the atmosphere. In many of such past system a volume of the exhaust gas from the engine was redirected to the intake air of the engine through the turbocharger and to the engine. Such systems caused the premature plugging of aftercooler cores and malfunctioning of the systems. Additionally, with such recirculation system deterioration of the exhaust flow was caused by deposit buildup.

The present invention is directed to overcoming one or more of the problems as set forth above.

DISCLOSURE OF THE INVENTION

In one aspect of the invention an exhaust gas recirculation system is adapted for use with an engine. The exhaust gas recirculation system is comprised of at least a cylinder being positioned within the engine. A flow of intake air entering the cylinder. A supply of combustible fuel entering the cylinder. A combustion process within the cylinder defining a flow of exhaust gas exiting therefrom. An exhaust valve regulator being interposed the flow of intake air and the flow of exhaust gas. The exhaust valve regulator being movable between an open position having a flow of exhaust gas passing to the flow of intake air and a closed position preventing a flow of exhaust gas passing to the flow of intake air. And, a particulate trap being positioned in the flow of exhaust gas passing to the flow of intake air.

In another aspect of the invention, a method of reducing exhaust emissions from an engine is comprised of the following steps. Passing a flow of exhaust gas through a particulate trap. Passing the flow of exhaust gas after passing through the particulate trap to a flow of intake air. Passing the flow of intake air and the flow of exhaust gas after passing through the particulate trap to a cylinder. And, combusting the flow of intake air and the flow of exhaust gas within the cylinder.

BEST MODE FOR CARRYING OUT THE INVENTION

Figure 1:
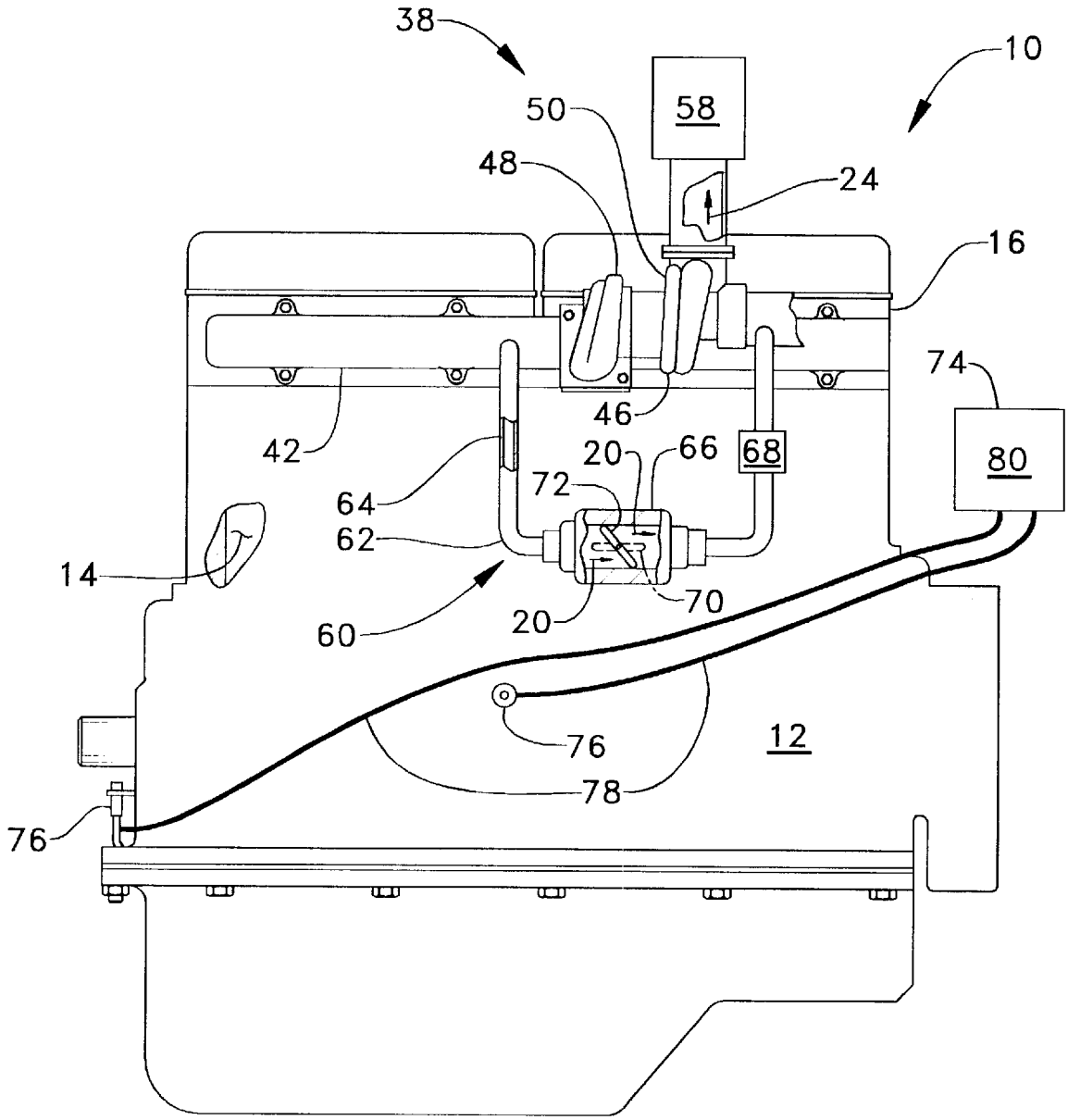
FIG. 1 is a schematically illustrated side view of an engine embodying the exhaust gas recirculation system.
Figure 2:
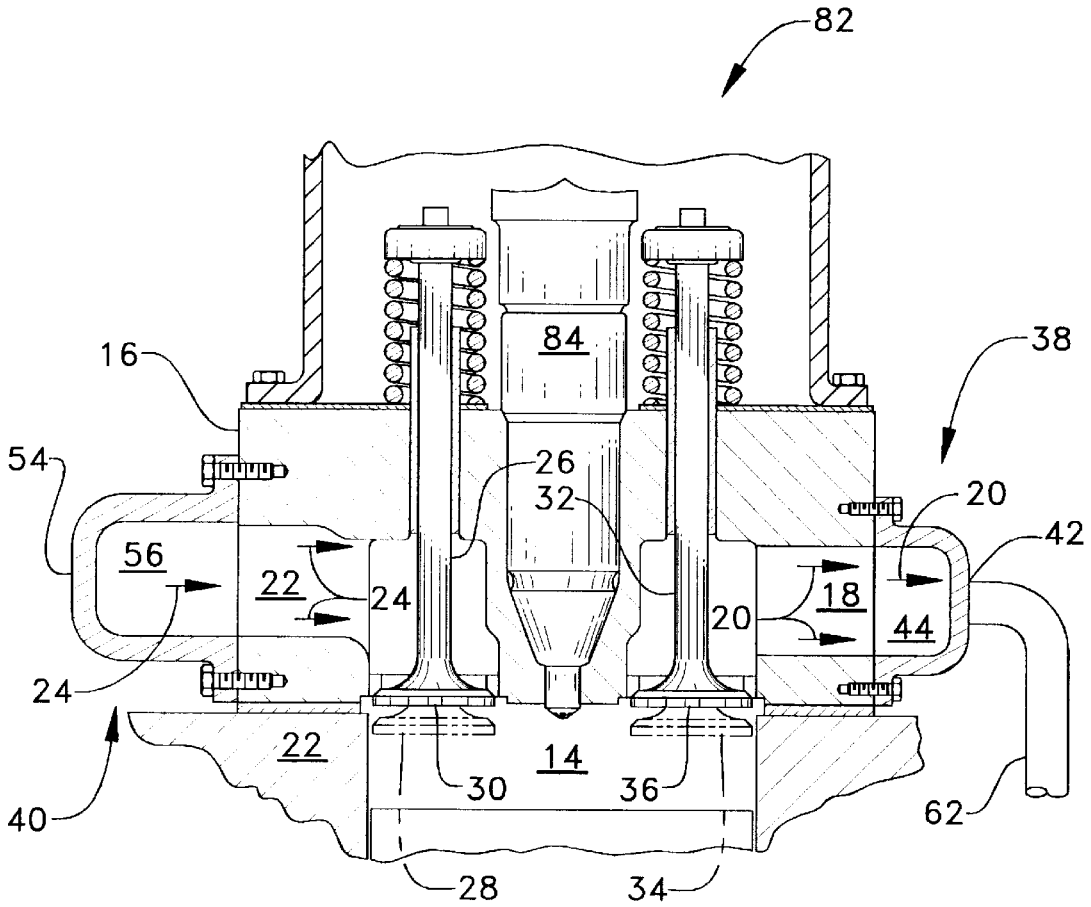
FIG. 2 is a cross-sectional view taken along line 2—2 of FIG. 1.

Referring to FIGS. 1 and 2, an engine 10 includes a block 12 having a plurality of cylinder 14 therein, of which only one is shown, and a head 16 attached to the block 12. The head 16 includes an exhaust passage 18, having a flow of exhaust gas designated by the arrows 20 therein, and an intake passage 22, having a flow of intake air designated by the arrows 24 therein. An intake valve 26, or in this application a pair of intake valves, are interposed the intake passage 22 and the respective one of the plurality of cylinders 14 and operatively moves between an open position 28, shown in phantom, and a closed position 30. An exhaust valve 32 or in this application a pair of exhaust valves, are interposed the exhaust passage 18 and the respective one of the plurality of cylinders 14 and operatively moves between an open position 34, shown in phantom and a closed position 36. An exhaust system 38 and an intake system 40 are removably attached to the engine 10 respectively.

The exhaust system 38, in this application, includes an exhaust manifold 42 defining an exhaust passage 44 therein being in communication with the exhaust passage 18 within the head 16. A turbocharger 46 is attached to the exhaust manifold 42 in a conventional manner and has a turbine section 48 operative connected to and being driven by the flow of exhaust gas 20 from a combustion process within the plurality of cylinders 14. The turbocharger 46 further includes a compressor section 50 being driven by the turbine section 48 in a conventional manner. The flow of exhaust gas 20 exits an exhaust opening, not shown, in the turbine section 48 and passes to the atmosphere.

The intake system 40 includes an intake manifold 54 defining an intake passage 56 therein being in communication with the intake passage 22 within the head 16. The compressor section 50 of the turbocharger 46 is operatively connected to the intake passage 54 in a conventional manner. The flow of intake air 24 is communicated from the atmosphere through a filter, not shown, to the compressor section 50 of the turbocharger 46 in a convention manner. The intake air 24 is communicated from the compressor section 50 through an aftercooler 58 and to the intake passage 56 within the intake manifold 54 in a conventional manner. And, is communicated into the intake passage 22 within the head 16 and to the plurality of cylinders 14.

An exhaust gas recirculation system 60 is operatively communicated between the flow of exhaust gas 20 and the flow of intake air 24. For example, in this application, a tube 62 having a passage 64 therein extends from the exhaust manifold 42 to the compressor section 50 of the turbocharger 46. An exhaust valve regulator 66 is positioned in the tube 62 and is interposed the exhaust manifold 42 and compressor section 50. In this application, a particulate trap 68 is positioned in the tube 62 and is interposed the exhaust valve regulator 66 and the flow of intake air 24. As an alternative, the particulate trap 68 could be positioned between the exhaust manifold 42 or the flow of exhaust gas 20 and the intake manifold 54 or the flow of intake air 24. Ideally, the particulate trap 68 should be located as near the exhaust manifold 42 as possible. The exhaust valve regulator 66 has an open position 70, shown in phantom, and a closed position 72. The exhaust valve regulator 66 is operatively movable through a infinite number of positions between the open position 70 and the closed position 72. Thus, the particulate trap 68 is positioned between the exhaust valve regulator 66 and the compressor section 50 of the turbocharger 46.

A control system 74 includes a plurality of sensors 76 being positioned about the engine 10. The plurality of sensors 76 monitor engine 10 operating parameters. Such parameters include speed, temperature, pressure and fuel quantity. A plurality of communication means 78 such as wires or electronic devices are interposed the plurality of sensors 76 and a controller 80, such as a computer. The controller 76 can be located onboard the engine 10 or can be remotely positioned from the engine 10.

A conventional fuel injection system 82 is used with the engine 10. The fuel injection system 82 include a flow of combustible fuel, not shown, and a plurality of injectors 84, only one being shown, operative connected to respective ones of the plurality of cylinder 14. The plurality of injectors 82 can be of conventional construction, such as, pump and lines or unit injectors.

Industrial Applicability

In use, the engine 10 is started. Fuel in supplied to each of the plurality of cylinders by the respective fuel injector 84 of the fuel system 82. Intake air 24 is supplied to the engine 10. For example, intake air 24 enters the compressor section 48 and is compressed. From the compressor section 50, intake air passes through the aftercooler 58 and is cooled becoming more dense and enters into the intake passage 56 in the intake manifold 54. From the intake passage 56, as the intake valve 26 is moved into the open position 28 intake air 24 is drawn into the respective one of the plurality of cylinders 14. The intake air 24 and the fuel are combusted. After combustion, as the exhaust valve 32 is moved into the open position 34 the combusted fuel and intake air 24 form the flow of exhaust gas 20. The flow of exhaust gas 20 enters the exhaust passage 44 of the exhaust manifold 42 and passes to the atmosphere.

Under predetermined operating conditions of the engine 10, the exhaust gas recirculation system 60 is actuated. One such predetermined operating condition that would use the exhaust gas recirculation system 60 would be with high load conditions of the engine 10. This condition would provide maximum emissions reduction, specially NOx. For example, the controller 80 receives a signal from at least one of the plurality of sensors 76. The signal is interpreted by the controller 80 and directs a command to the exhaust valve regulator 66. The exhaust valve regulator 66 is moved in a conventional manner from the closed position 72 to the open position 70. Thus, a flow of exhaust gas 20 is allowed to flow through the exhaust valve regulator 66 and the particulate trap 68 and into and mixes with the flow of intake air 24. In the process of passing through the particulate trap 68, the flow of exhaust gas is cleaned. For example, soot is removed from the flow of exhaust gas. Thus, soot is prevented from entering the turbocharger 46 and aftercooler 58. The elimination of the soot from the flow of exhaust gas 20 reduces or eliminates premature failure of the turbocharger 46 and clogging of the aftercooler 58. Additionally, soot from the exhaust gas recirculation causes deposit buildup and clogging within the intake manifold passage 56, the intake passage 22 within the head 16 and on the intake valve 26.

With the present exhaust gas recirculation system 60 and with the control system 74 operational, the controller 80 receives at least a signal from one of the plurality of sensors 76, interprets the signal and operates the exhaust gas recirculation system 60. For example, as interpreted by the controller 80 the exhaust valve regulator 66 is moved between the open position 70 and the closed position 72 depending on the engine 10 operational map or conditions. Thus, as the operating conditions of the engine 10 necessitate the amount of exhaust gas recirculation or flow of exhaust gas 20 is varied and the emissions are controlled within a preestablished parameter. And, with the soot being filtered from the flow of exhaust gas 20 the negative effects of the soot acting on the turbocharger 46, aftercooler 58, the intake passages 56,22 and the intake valve 26 are eliminated.

Other aspects, objects and advantages of this invention can be obtained from a study of the drawings, the disclosure and the appended claims.

I claim:

1. An exhaust gas recirculation system being adapted for use with an engine, comprising:

at least a cylinder being positioned within said engine;

a flow of intake air entering said cylinder;

a supply of combustible fuel entering said cylinder;

a combustion process within said cylinder defining a flow of exhaust gas exiting therefrom;

an exhaust valve regulator being interposed said flow of intake air and said flow of exhaust gas, said exhaust valve regulator being movable between an open position having a flow of exhaust gas to be recirculated passing to said flow of intake air and a closed position preventing a flow of exhaust gas passing to said flow of intake air; and a particulate trap being positioned in said flow of exhaust gas to be recirculated and all of said flow of exhaust gas to be recirculated passing through said particulate trap prior to passing to said flow of intake air.

2. The exhaust gas recirculation system of claim 1 wherein said exhaust valve regulator being movable between said open position and said closed position through an infinite number of positions.

3. The exhaust gas recirculation system of claim 1 wherein a control system operatively controls said open position and said closed position of said exhaust valve regulator.

4. The exhaust gas recirculation system of claim 3 wherein said control system includes a controller and a sensor, said sensor being positioned on said engine and monitoring an operating parameter of said engine, said operating parameter being communicated to said controller by a signal.

5. The exhaust gas recirculation system of claim 4 wherein said controller interprets said signal and moves said exhaust valve regulator to a preestablished position between said open position and said closed position.

6. The exhaust gas recirculation system of claim 3 wherein said control system includes a controller and a plurality of sensors, said plurality of sensors being positioned on said engine and each of said plurality of sensors monitoring an individual operating parameter of said engine, said individual operating parameters being communicated to said controller by an individual signal.

7. The exhaust gas recirculation system of claim 6 wherein said controller interprets said signals and moves said exhaust valve regulator to a preestablished position between said open position and said closed position.

8. The exhaust gas recirculation system of claim 1 wherein said engine includes a turbocharger being interposed said cylinder and said particulate trap.

9. The exhaust gas recirculation system of claim 1 wherein said engine includes an aftercooler being operatively attached to said engine and said flow of intake air passing through said aftercooler before entering said cylinder.

10. A method of reducing exhaust emissions from an engine, said method comprising the steps of:

passing an amount of a flow of exhaust gas through an exhaust valve regulator;

passing said said amount of said flow of exhaust gas through a particulate trap;

passing said amount of said flow of exhaust gas after passing through said particulate trap to a flow of intake air;

passing said flow of intake air and said flow of exhaust gas after passing through said particulate trap to a cylinder; and combusting said flow of intake air and said flow of exhaust gas within said cylinder.

11. The method of reducing exhaust emissions of claim 10 wherein said step of passing said flow of intake air and said flow of exhaust gas after passing through said particulate trap to a cylinder includes said flow of intake air and said flow of exhaust gas passing through a turbocharger before passing to said cylinder.

12. The method of reducing exhaust emissions of claim 10 wherein said step of passing said flow of intake air and said flow of exhaust gas after passing through said particulate trap to a cylinder includes said flow of intake air and said flow of exhaust gas passing through an aftercooler before passing to said cylinder.

13. The method of reducing exhaust emissions of claim 10 wherein said step of passing said flow of intake air and said flow of exhaust gas after passing through said particulate trap to a cylinder includes said flow of intake air and said flow of exhaust gas passing through a turbocharger and an aftercooler before passing to said cylinder.

14. The method of reducing exhaust emissions of claim 10 wherein said step of passing said flow of exhaust gas through a particulate trap includes a control system operatively controlling a position of an exhaust valve regulator between an open position and a closed position defining a quantity of said flow of exhaust gas.

15. The method of reducing exhaust emissions of claim 14 wherein said operatively controlling said position of said exhaust valve regulator between said open position and said closed position includes sensing an operating parameter of said engine and sending a signal representing said operating parameter to a controller, said controller interpreting said signal and moving said exhaust valve regulator between said open position and said closed position.

16. The method of reducing exhaust emissions of claim 15 wherein said moving said exhaust valve regulator between said open position and said closed position includes said moving defining an infinite number of positions.

17. The method of reducing exhaust emissions of claim 14 wherein said operatively controlling said position of said exhaust valve regulator between said open position and said closed position includes sensing a plurality of operating parameters of said engine and sending a signal representing each of said operating parameters to a controller, said controller interpreting said signals and moving said exhaust valve regulator between said open position and said closed position.

18. The method of reducing exhaust emissions of claim 17 wherein said moving said exhaust valve regulator between said open position and said closed position includes said moving defining an infinite number of positions.

19. The method of reducing exhaust emissions of claim 10 wherein only said flow of exhaust gas being mixed with said flow of intake air being passed through said particulate trap.

* * * * *